United States Patent [19]

Gregg

[11] 3,979,777

[45] Sept. 14, 1976

[54] SWIM HELMET

[75] Inventor: Frank M. Gregg, Philadelphia, Pa.

[73] Assignee: Lawrence Peska Associates, Inc., New York, N.Y. ; a part interest

[22] Filed: Jan. 29, 1975

[21] Appl. No.: 544,866

[52] U.S. Cl. ..... 2/68
[51] Int. Cl.[2] ..... A42B 1/12
[58] Field of Search ..... 2/68

[56] References Cited

UNITED STATES PATENTS

| | | | |
|---|---|---|---|
| 1,482,723 | 2/1924 | Auster et al. | 2/68 |
| 1,546,163 | 7/1925 | Auster et al. | 2/68 |
| 1,761,302 | 6/1930 | Howland | 2/68 |
| 1,919,032 | 7/1933 | Neulander | 2/68 |
| 2,215,198 | 9/1940 | Silbert | 2/68 X |

FOREIGN PATENTS OR APPLICATIONS

| | | | |
|---|---|---|---|
| 321,907 | 11/1929 | United Kingdom | 2/68 |

*Primary Examiner*—Alfred R. Guest
*Attorney, Agent, or Firm*—Richard E. Nanfeldt

[57] ABSTRACT

A swim helmet has a round top portion, a pair of downward extending sidewalls, a downward extending rear wall, and an open front face, wherein the helmet conforms to the curvative of a person's head. A lower marginal edge of the helmet completely covers the hairline of the person. A chin strap member detachably communicates between the lobe portions of the sidewalls of the helmet. Each lobe portion of the helmet has an ear cover container therein, wherein the ear cover container serves as a protective device for the ears of the person.

3 Claims, 3 Drawing Figures

SWIM HELMET

SUMMARY OF THE INVENTION

My present invention relates to a unique and novel head gear worn as a protective swim helmet, wherein the design of the helmet is especially adaptable to the male swimmer as a protective device for his hair and ears. Heretofore, swim caps have been especially designed for women, wherein a suitable ear protective device has been employed separately.

A number of U.S. Pat. Nos. 3,274,612; 3,503,076; and 3,793,110 have employed various designed swimming caps, but these aforementioned patents are nonrelated to my present invention.

It is an object of my present invention to provide a swim helmet having a built-in ear cover within each lobe portion of the helmet, wherein the helmet consists of a flexible rubber material capable of conforming to the curvative of the head such that the lower marginal edge of the helmet covers the hairline of the person.

Briefly, my present invention consists of a round top portion, a pair of downward extending sidewalls, a downward extending rear wall, and an open front face, wherein the helmet conforms to the curvative of a person's head. A lower marginal edge of the helmet completely covers the hairline of the person. A chin strap member detachably communicates between the lobe portions of the sidewalls of the helmet. Each lobe portion of the helmet has an ear cover container therein, wherein the ear cover serves as a protective device for the ears of the person.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
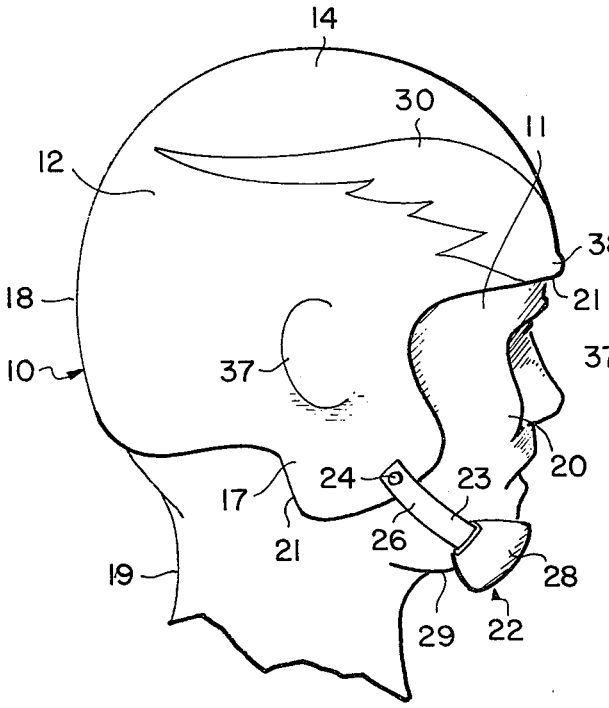
FIG. 1 illustrates a side view of a swim helmet on a person's head.
Figure 2:
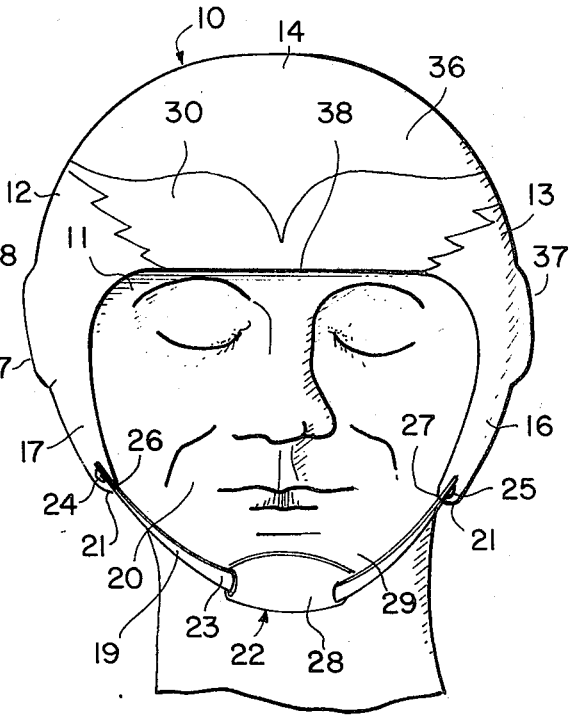
FIG. 2 illustrates a front view of the swim helmet on the person's head.

Turning now descriptively to the drawings, in which similar reference characters denote similar elements throughout the several views, FIGS. 1–2 show a swim helmet 10 used generally by a male for protection of the hair and ears 15. The helmet 10 having a generally rounded top portion 14 designed to fit over the top of a person's head 11, wherein the helmet 10 conforms to the curvative of the head 11. Sidewalls 12, 13 extend downwardly from the top portion 14 to a sufficient length below the person's ears 15 forming lobe portions 16, 17 of the helmet 10. The rear wall 18 of the helmet 10 extends downwardly to a sufficient length to engage the nape of the neck 19 of the person. The front of the helmet 10 is open so as to expose the face 20 to the person. The lower marginal edges 21 of a forward part 38 of the top portion 14, the rear wall 18 and the sidewalls 12, 13 of the helmet 10 are curved so as to cover completely the hairline of the person. A chin guard strap member 22 consists of an elongated strap portion 23 having male portions of snap members 24, 25 at each end 26, 27 of strap portion 23. A hard rubber pad member 28 is contained centrally on strap portion 23. The male portions of snap members 24, 25 communicate with female portions of the snap members 24, 25 embedded in the lobe portions 16, 17, wherein the hard rubber pad member 28 engages the chin 29 of the person. A plurality of designs 30 are printed on the outside surface 36 of the helmet 10. The helmet 10 is formed from a soft flexible rubber material of an elasticity similar to a latex rubber, wherein the helmet 10 will snuggly engage the person's head 11.

Figure 3:
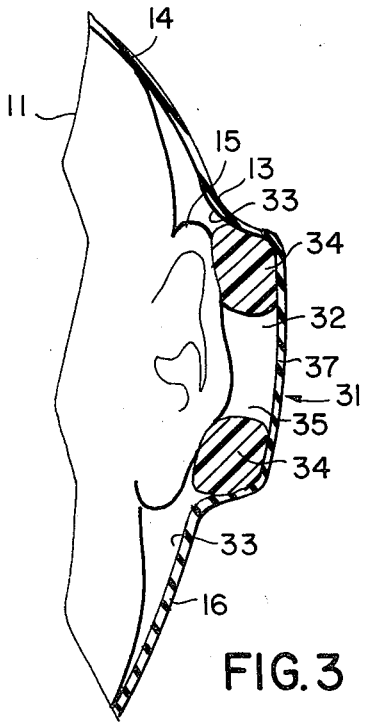
FIG. 3 illustrates a front cross sectional view of a ear cover contained in a lobe portion of the helmet, wherein the ear cover engages a person's ear.

FIG. 3 shows an ear cover 31, wherein identical covers 31 are contained in each lobe portion 16, 17 of the helmet. The ear cover 31 consists of the lobe portion 16 of the helmet 10 having an outward extension 37 forming an oblong shaped interior recess 32 on the interior face 33 of the lobe portion 16. An oblong shaped foam rubber member 34 having a central opening 35 therethrough is contained within the recess 32. The foam rubber member 34 engages the ear 15 of the person as a protective aid, wherein a water tight seal is formed with the ear 15.

Hence, obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A swim helmet adapted to be worn on a person's head, which comprises a rounded top portion having downwardly extending sidewalls, a downwardly extending rearwall, an open front face, said helmet conforming to a curvative of said person's head, said sidewalls extending downwardly to form lobe portions covering the ears of said person, each said lobe portion having an outward extension forming an oblong recess on an interior surface of each said lobe portion of said helmet, a bottom marginal edge of said rearwall, said sidewall and a forward portion of said rounded top covering a hairline of said person, a chin strap member detachably communicating with each said lobe portion, and a pair of oblong shaped foamed rubber members, each said member having a central opening therethrough, one said member disposed within each said oblong recess forming a water tight seal with said ears.

2. A swim helmet as recited in claim 1, wherein said helmet is formed from a soft flexible rubber.

3. A swim helmet as recited in claim 2, wherein an outside surface of said swim helmet has a design printed thereon.

* * * * *